US011457704B2

(12) United States Patent
Hoffman

(10) Patent No.: US 11,457,704 B2
(45) Date of Patent: Oct. 4, 2022

(54) MINIMALIST WALLET

(71) Applicant: Christopher Hoffman, Bayonne, NJ (US)

(72) Inventor: Christopher Hoffman, Bayonne, NJ (US)

( * ) Notice: Subject to any disclaimer, the term of this patent is extended or adjusted under 35 U.S.C. 154(b) by 488 days.

(21) Appl. No.: 16/566,289

(22) Filed: Sep. 10, 2019

(65) Prior Publication Data

US 2020/0077758 A1 Mar. 12, 2020

Related U.S. Application Data

(60) Provisional application No. 62/729,064, filed on Sep. 10, 2018.

(51) Int. Cl.
*A45C 1/06* (2006.01)

(52) U.S. Cl.
CPC ..... *A45C 1/06* (2013.01); *A45C 2001/067* (2013.01)

(58) Field of Classification Search
CPC .. A45C 2001/067; A45C 13/1069; A45C 1/06
USPC ..... 150/143, 147, 149
See application file for complete search history.

(56) References Cited

U.S. PATENT DOCUMENTS

D308,291 S 6/1990 O'Neal
D372,358 S 8/1996 Mathison
5,653,276 A * 8/1997 Niernberger ..... A45C 1/06 150/147
D409,464 S 5/1999 Garza
D411,766 S 7/1999 Veros, Sr.
D429,068 S 8/2000 Kleinsmith
D434,899 S 12/2000 Kojoori
D435,339 S 12/2000 Cleveland
6,427,836 B1 8/2002 Bolanos
6,684,544 B1 * 2/2004 Buettell ..... G09F 7/04 40/661.01
D527,899 S 9/2006 Morehead
7,117,990 B2 10/2006 Sarif
D538,704 S 3/2007 Kaminski
D551,446 S 9/2007 Elnekaveh et al.
D552,008 S 10/2007 McGarity
D581,311 S 11/2008 Cornett
D591,044 S 4/2009 Lakhiani
D592,987 S 5/2009 McGarity et al.
D602,689 S 10/2009 Hewitt
(Continued)

FOREIGN PATENT DOCUMENTS

CN 106217315 A 12/2016
DE 9210013 U1 3/1993
(Continued)

*Primary Examiner* — Sue A Weaver
(74) *Attorney, Agent, or Firm* — Gearhart Law LLC

(57) ABSTRACT

A minimalist wallet is provided. The minimalist wallet includes a frame with an embedded magnetic material. A first band and a second band are attached to the frame. A securement mechanism is attached to the second band. The securement mechanism includes a magnet that is magnetically attachable to the embedded magnetic material. Alternatively, the frame may include the magnet that is magnetically attachable to a magnetic material embedded in the securement mechanism. The minimalist wallet is configured to retain receipts, coupons, credit cards, debit cards, and/or paper money, among others.

14 Claims, 7 Drawing Sheets

(56) References Cited

U.S. PATENT DOCUMENTS

| | | | | |
|---|---|---|---|---|
| D622,957 | S | 9/2010 | Marshall | |
| D653,851 | S | 2/2012 | Flyvholm | |
| D668,045 | S | 10/2012 | Robbins | |
| D683,960 | S | 6/2013 | Robbins | |
| D684,362 | S | 6/2013 | Robbins | |
| D688,586 | S | 8/2013 | Tobin | |
| D691,367 | S | 10/2013 | Chappell | |
| D703,949 | S | 5/2014 | Chappell | |
| D710,741 | S | 8/2014 | Hirschom | |
| D717,197 | S | 11/2014 | Kinskey | |
| D719,143 | S | 12/2014 | Vidovic | |
| 9,314,074 | B2 | 4/2016 | Johnson et al. | |
| D758,724 | S | 6/2016 | Guest | |
| D775,824 | S | 1/2017 | King | |
| D780,449 | S | 3/2017 | King | |
| D794,328 | S | 8/2017 | King | |
| D798,591 | S | 10/2017 | King | |
| 9,826,810 | B2 | 11/2017 | Singer | |
| D806,386 | S | 1/2018 | King | |
| D808,158 | S | 1/2018 | King | |
| D809,792 | S | 2/2018 | Moon | |
| D835,410 | S | 12/2018 | Chan | |
| 2006/0201594 | A1 | 9/2006 | Carmichael | |
| 2009/0020570 | A1* | 1/2009 | Chan | A45F 5/00 224/222 |
| 2010/0122438 | A1 | 5/2010 | Amron | |
| 2013/0056119 | A1 | 3/2013 | Henriette | |
| 2015/0059937 | A1 | 3/2015 | Singer | |
| 2015/0083289 | A1 | 3/2015 | Johnson et al. | |
| 2016/0324283 | A1* | 11/2016 | Kane | A45C 11/182 |
| 2017/0035169 | A1* | 2/2017 | Haarburger | A45C 1/06 |
| 2017/0119115 | A1* | 5/2017 | King | A45C 11/182 |
| 2017/0135452 | A1 | 5/2017 | Kane | |
| 2018/0064223 | A1 | 3/2018 | Singer | |
| 2018/0116352 | A1 | 5/2018 | Despain | |
| 2018/0123630 | A1* | 5/2018 | Li | H04B 1/3818 |

FOREIGN PATENT DOCUMENTS

| | | | |
|---|---|---|---|
| DE | 4323105 | A1 | 1/1995 |
| DE | 10250656 | A1 | 5/2004 |
| EP | 1425985 | A2 | 6/2004 |
| KR | 19980013021 | U | 6/1998 |
| WO | 2016179586 | A1 | 11/2016 |

* cited by examiner

MINIMALIST WALLET

CLAIM OF PRIORITY

This application is related to and claims the benefit of U.S. Provisional Patent Application Ser. No. 62/729,064, filed Sep. 10, 2018 titled "Minimalist Wallet," which is incorporated by reference herein in its entirety for all purposes.

FIELD OF THE EMBODIMENTS

The present invention and its embodiments relate generally to storage devices for securing credit cards, identification cards, money, etc. In particular, the storage device is designed to be minimalist in nature while providing secure storage for the desired financial and identification instruments.

BACKGROUND OF THE EMBODIMENTS

Purses, wallets, handbags, clutches, pocketbooks, and the like are ubiquitous in today's society. For many, wallets are not only uncomfortable to sit on when placed in a rear pocket of a pair of trousers, but can actually be physically damaging to spinal alignment, proper alignment between spine and hip bones, and so forth.

As noted above, wallets are typically configured to be carried in a front breast pocket of a suit coat, in a rear pocket of trousers, or in a purse. Typically, wallets will have many features, pockets, specialized slots or retainers, and the like. This allows for easy access and storage of numerous items in a "limited" space.

However, the result of the foregoing is a comparatively large, heavy, complex, thick system demanding its own accommodation whenever an individual decides to carry it. It would be desired in the art to create a wallet that removes the need for a heavy bulky wallet. It would be desired to create for such a wallet an organizational scheme that is effective yet simple. It would be a further advance to develop a wallet and organizational scheme making contents readily available for viewing, removing, and inserting while leaving said items securely positioned within the confines of the wallet.

Such an improved wallet should be comparatively light weight, compact, functional, and yet able to fit paper money, credit cards, and receipts, and the like in a convenient single form factor. Further, simplistic access and removal/storage of contents into the wallet, and the like would be advantageous. The present invention and its embodiments meet and exceed these objectives.

REVIEW OF RELATED TECHNOLOGY

U.S. Patent Application 2018/0116352 pertains to a minimalist wallet provides capture and ready access to credit cards, paper money bills, and receipts in a single pocket covered by a closure acting as a guide to fold money and receipts. Credit cards act as a bender or edge around which to bend bills and receipts. The closure tucks into the pocket and the entire wallet fits within a shirt pocket, a front or rear trouser pocket, or in a jacket, sweater, or the like with minimum profile. Relieved corners (open corners; non-corners) permit the wallet to thin down to minimum content or expand to maximum content. The wallet is simple, adaptable, renders all the content readily visible, yet secures all contents so long as it remains within any pocket of clothing or luggage.

U.S. Patent Application 2010/0122438 pertains to a magnetic money clip is provided having a paper substrate, which may be a real banknote, connecting two or more magnetic components to create a low-cost, thin, soft magnetic vise-like mechanism. The user can simply peel back the substrate to open the magnetic vise-like mechanism to insert or remove one or more banknotes. The user then folds the substrate back onto itself to close and secure the remaining banknote(s).

U.S. Patent Application 2006/0201594 pertains to a low-profile wallet apparatus for securing relatively small items to a person that may be opened with one hand, the wallet having a closure mechanism to secure a first portion to a second portion, the closure system being provided to create a seal to securely maintain the items in the wallet. The wallet, or at least portions thereof may advantageously be provided of a wicking or breathable material.

Various devices are known in the art. However, their structure and means of operation are substantially different from the present disclosure. The other inventions also fail to solve all the problems taught by the present disclosure. At least one embodiment of this invention is presented in the drawings below and will be described in more detail herein.

SUMMARY OF THE EMBODIMENTS

Generally, the present invention and its embodiments provide for a minimalist wallet configured to hold credit cards, debit cards, receipts, coupons, identification, and the like or some combination thereof. The minimalist wallet has a frame that forms the "backbone" of the wallet. The frame provides rigidity as well as a surface by which the other components are attached. The frame further allows for the visualization of certain items stored within the wallet. Furthermore, the frame includes rounded outer edges to improve comfort during use and transportation.

The wallet contains at least one and preferably two or more bands that are coupled to the frame and sized and shaped to form additional compartments. The bands may be removably coupled to the frame such that the band style, size, color, etc. may be changed as desired.

The wallet further incorporates an integrated bottle opening device which is formed as part of the frame. Additionally, there is a securement mechanism which has an embedded magnet. This securement mechanism is configured to attach to a portion of the frame that includes an embedded magnetic material. This allows the items held in the compartment formed by the first band and the frame to be selectively retained. Further, the securement mechanism provides a haptic mechanism that allows a user to feel when an object has been removed/inserted into the main compartment of the wallet In one embodiment of the present invention there is a minimalist wallet including a frame, a first band coupled to the frame, a second band coupled to the frame, and a securement mechanism coupled to the second band. Magnetic material may be embedded into the frame. The securement mechanism may include an embedded magnet.

In another embodiment of the present invention there is a minimalist wallet having a frame having a first side, a second side, and a third side, a first band having a first end and a second end, the first end of the first band being coupled to the first side and the second end of the first band being coupled to the second side, and a second band having a first end and a second end, the first end of the second band being coupled to the third side and the second end having a securement device disposed. A steel strip may be embedded in the frame. The securement device may include an embedded magnet. The first band may be positioned between the frame and the second band.

In yet another embodiment of the present invention there is a minimalist wallet having a frame with an open portion, a first side, a second side, and a third side. A magnet may be embedded in the frame. The wallet may further include a first band with a first end and a second end, the first end of the first band being coupled to the first side and the second end of the first band being coupled to the second side. The first band may be coupled to the frame with a first removable clasp. The wallet may further include a second band with a first end and a second end, the first end of the second band being coupled to the third side and the second end with a securement device. The securement device may include an embedded magnetic material, the second may be attached to the frame with a second removable clasp. The first band may be positioned between the frame and the second band. The embedded magnet is configured to magnetically attach to the embedded magnetic material.

In general, the present invention succeeds in conferring the following, and others not mentioned, benefits and objectives.

It is an object of the present invention to provide a minimalist wallet that is lightweight and portable.

It is an object of the present invention to provide a minimalist wallet that provides immediate access to items stored within the wallet.

It is an object of the present invention to provide a minimalist wallet that provides a magnetic securement mechanism.

It is an object of the present invention to provide a minimalist wallet that has multiple storage compartments.

It is an object of the present invention to provide a minimalist wallet that provides utilitarian functionality.

It is an object of the present invention to provide a minimalist wallet that provides a tactile securement mechanism to ensure proper retrieval and storage of items stored in the wallet.

It is an object of the present invention to provide a minimalist wallet that has interchangeable components.

It is an object of the present invention to provide a minimalist wallet that is rugged and resilient.

It is an object of the present invention to provide a minimalist wallet that provides visual access to items stored in certain compartments of the wallet.

DETAILED DESCRIPTION OF THE EMBODIMENTS

Figure 1:
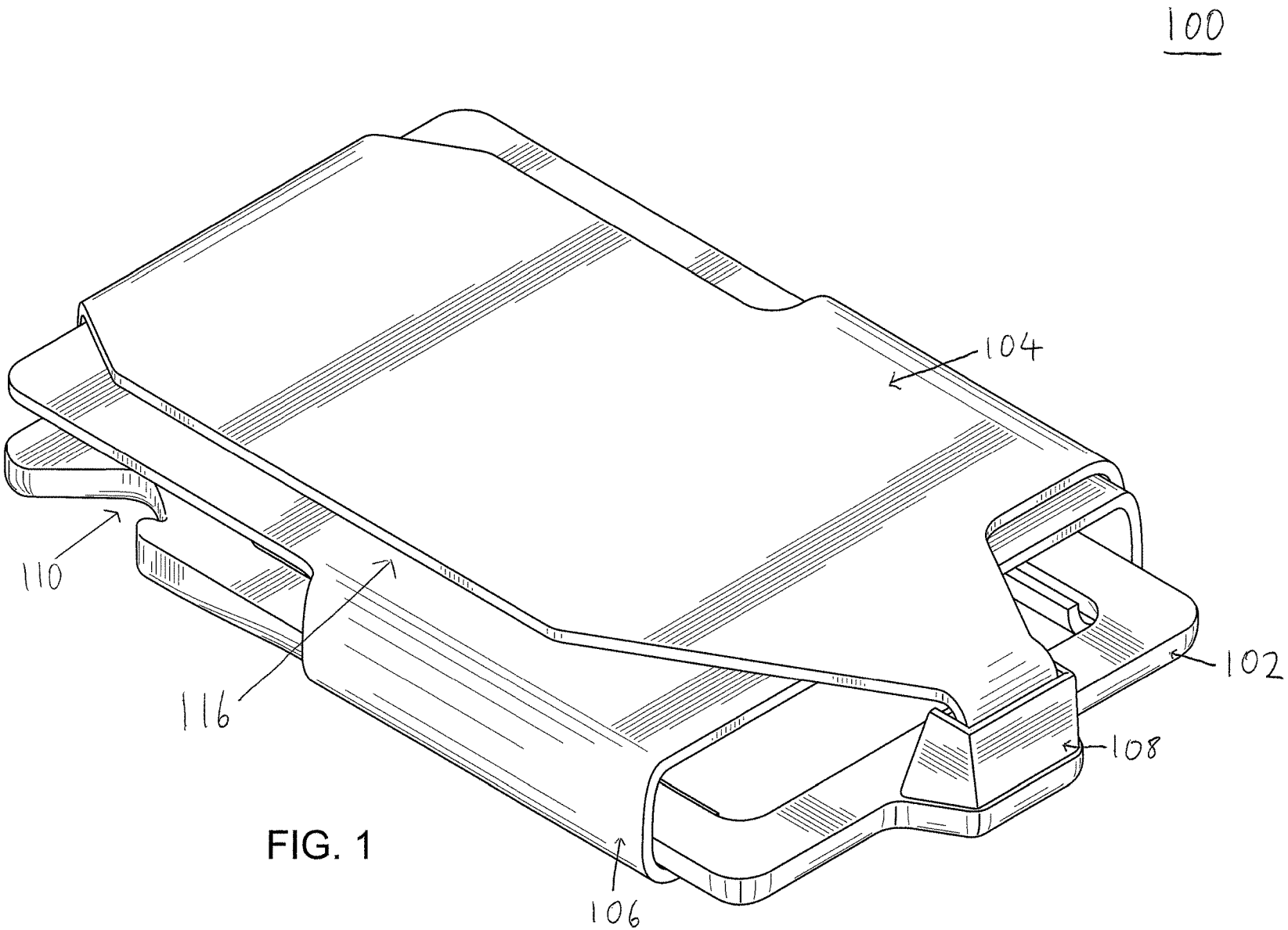
FIG. 1 shows a perspective bottom view of an embodiment of the present invention.
Figure 2:
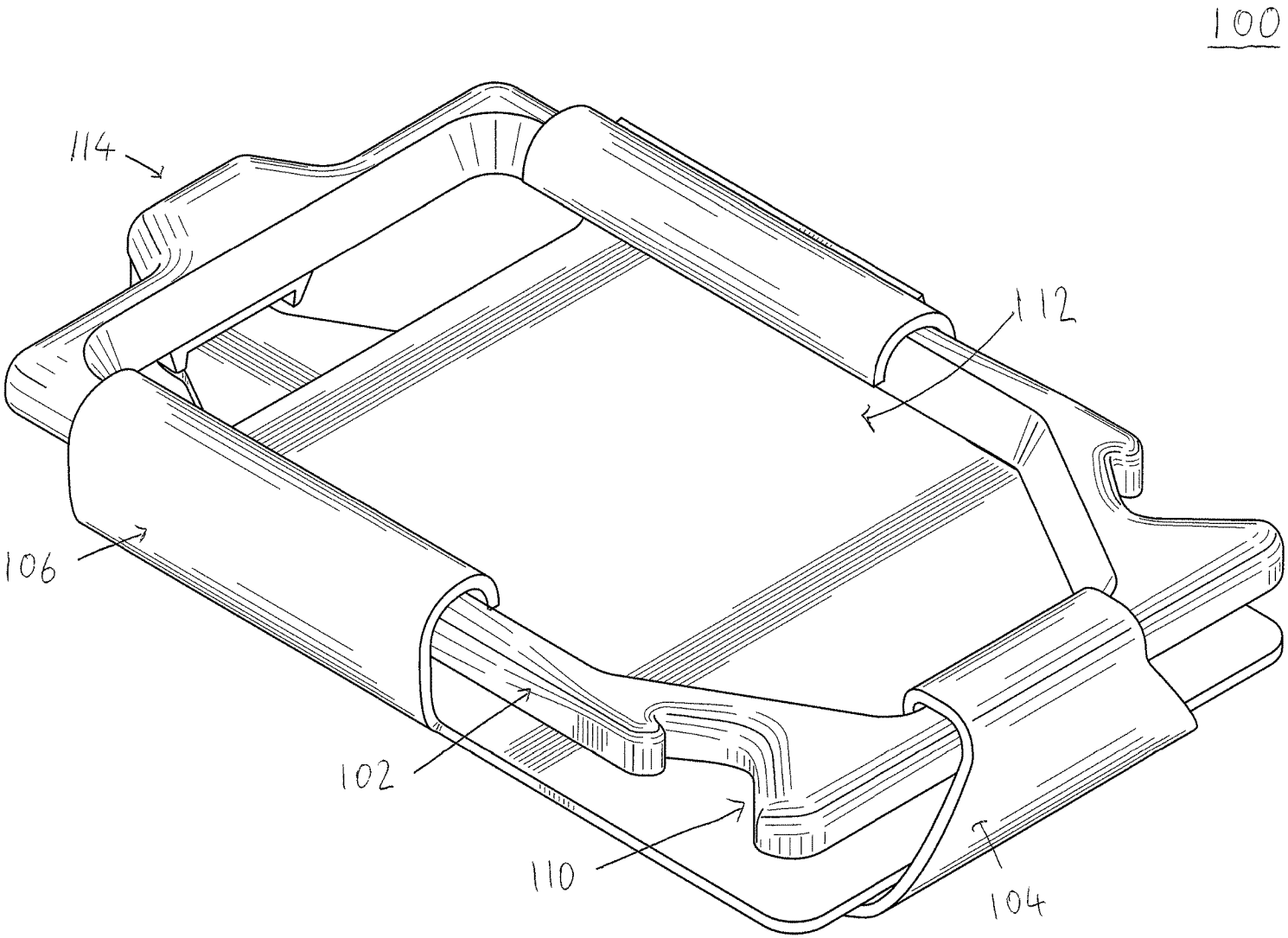
FIG. 2 shows a perspective top view of an embodiment of the present invention.
Figure 3:
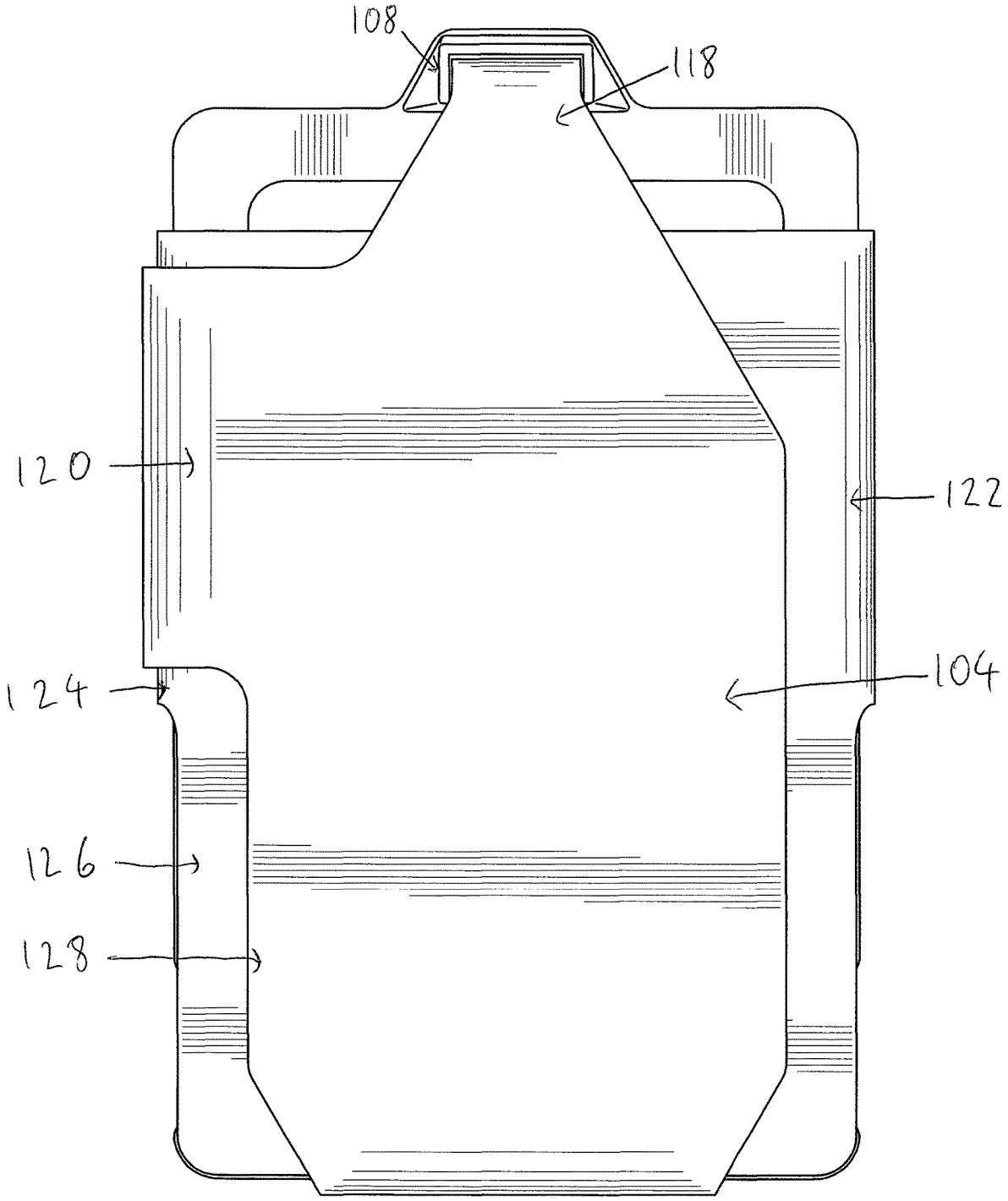
FIG. 3 shows a bottom view of an embodiment of the present invention.
Figure 4:
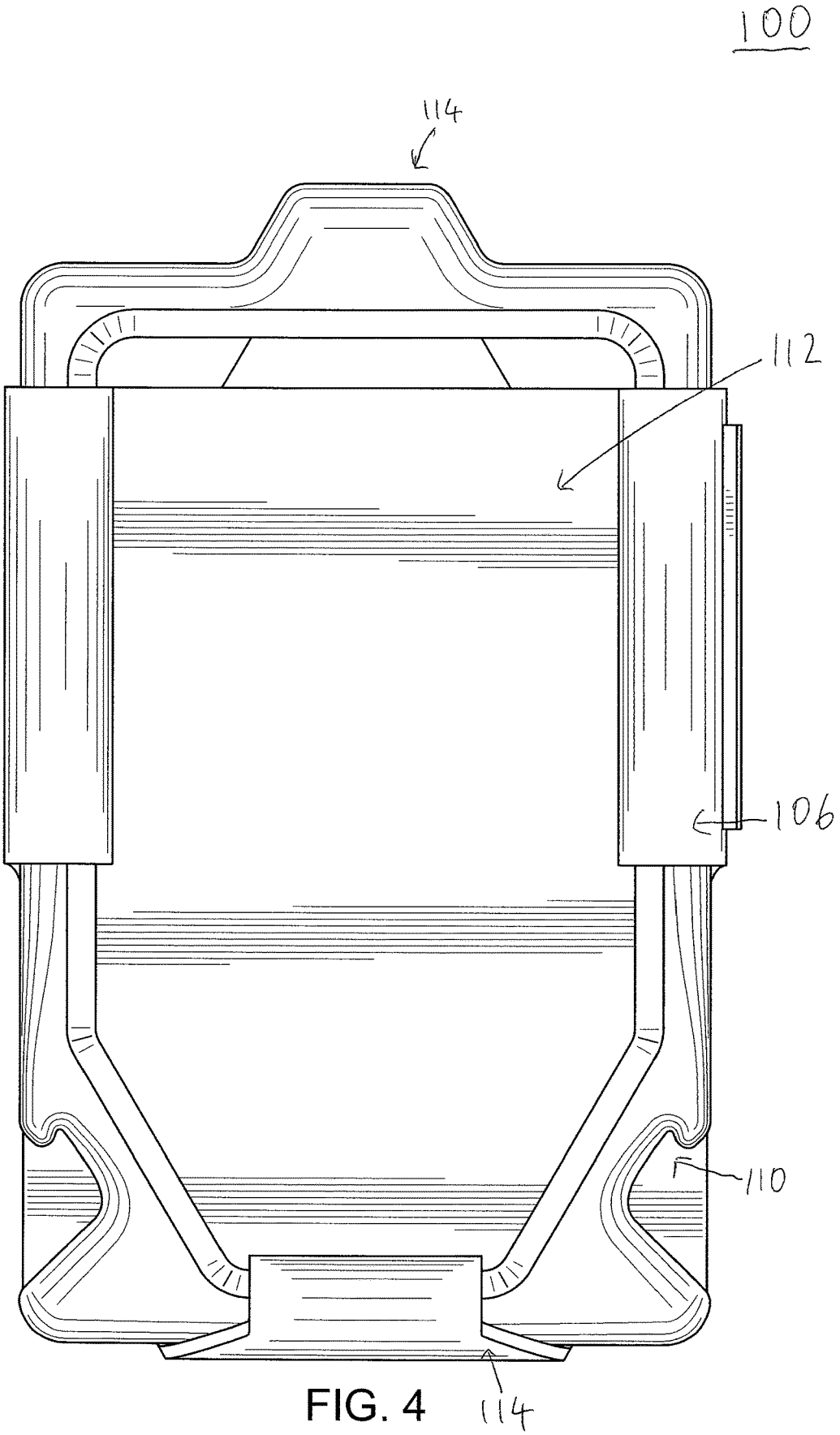
FIG. 4 shows a top view of an embodiment of the present invention.
Figure 5:
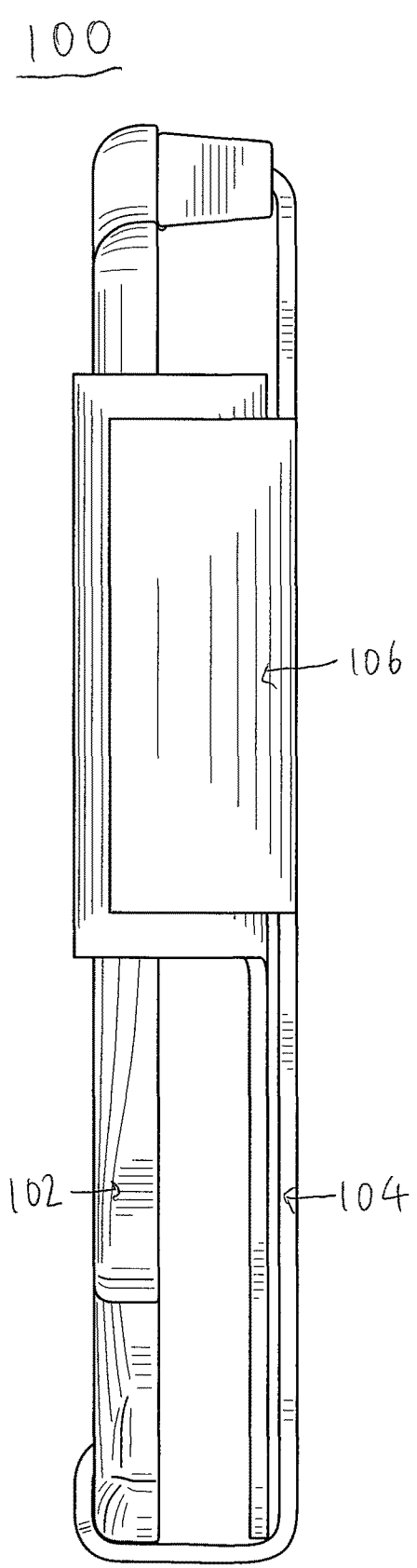
FIG. 5 shows a left side view of an embodiment of the present invention.
Figure 6:
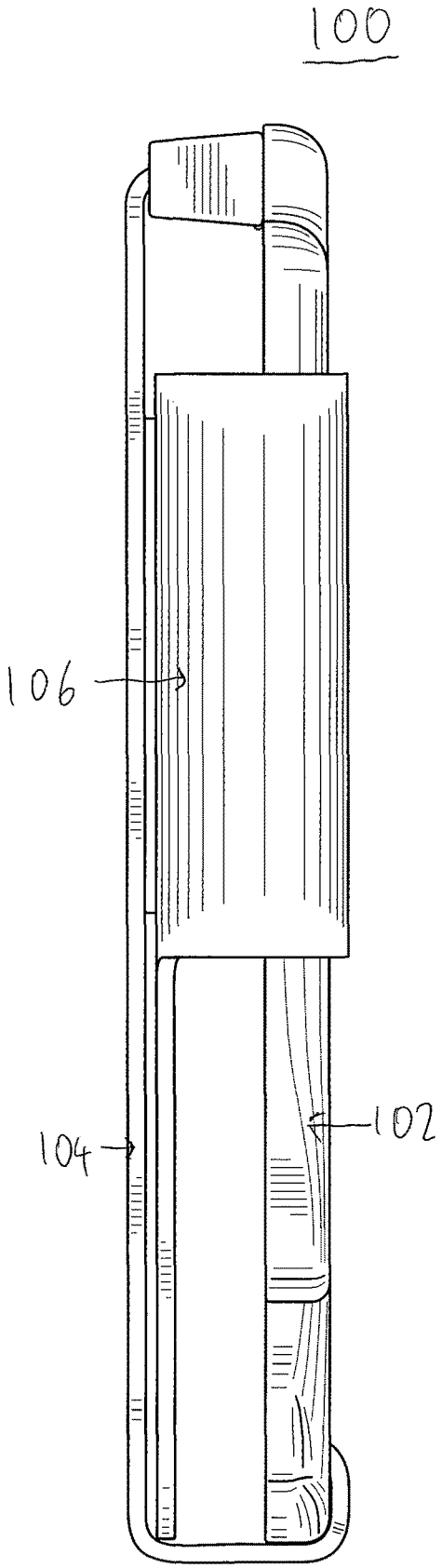
FIG. 6 shows a right side view of an embodiment of the present invention.
Figure 7:
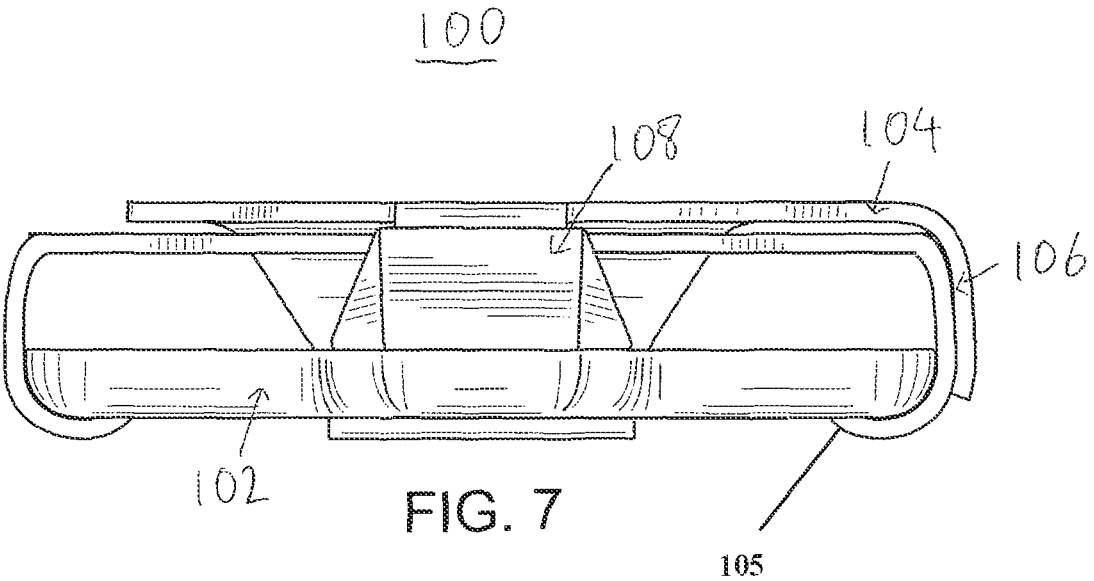
FIG. 7 shows a front view of an embodiment of the present invention.
Figure 8:
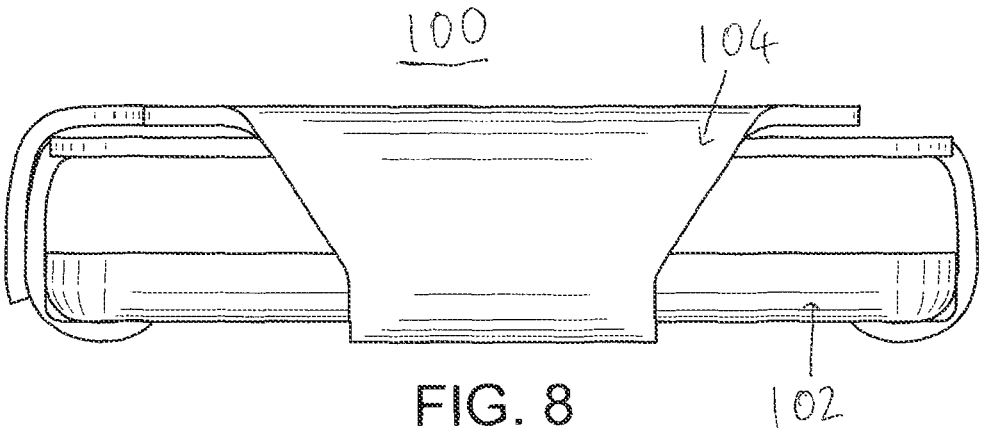
FIG. 8 shows a back view of an embodiment of the present invention.

The preferred embodiments of the present invention will now be described with reference to the drawings. Identical elements in the various figures are identified with the same reference numerals.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIGS. 1-9, there is an embodiment of minimalist wallet 100 in accordance with the present invention. The wallet 100 generally has a frame 102, first band 106, second band 104, securement mechanism 108. Magnets 132 embedded into the securement mechanism 108 may be magnetically attached to a magnetic material 130 embedded into the frame 102.

The frame 102 may be formed from a number of materials including but not limited to polymers, metals, rubber, wood, glass, composites, and the like or some combination thereof. In at least one embodiment, the frame 102 is printed using a 3-D printer. The frame 102 may contain a number of features and structure but generally is quadrilateral in appearance having at least a first side, second side, third side, and fourth side. In other embodiments, there may be more or less sides to the frame.

The frame 102 may further comprise a bottle opener 110, an opening 112, and a flared/protruding portion 114. The bottle opener 110 is preferably integrated with the frame 102. That is, that the bottle opener 110 is not a separate structure from the frame, and may be 3-D printed as part of the frame. In some embodiments, the bottle opener 110 may have a covering of an internal structure that provides additional support and leverage to the bottle opener 110 without fear that the frame 102 will crack or break.

The opening 112 in the frame 102 forms an inner perimeter of the frame 102 which allows a user or a third party to visually identify items stored within the wallet 100. This may be particularly helpful if the user is trying to remove the correct denomination of paper money or the correct financial instrument from the wallet 100. In other instances, this convenient opening 112 may allow for a third party to identify/verify the identification of the user without the need to flip through the wallet 100 or otherwise expose the identification. Further, it should be noted that even with the opening 112 it is intended that all items stored within will be readily secured between the frame 102 and the first band 106 and second band 104 combination. In some embodiments, an additional member is inserted between the frame 102 and the first band 106 to provide additional security to the items contained therein.

Figure 9:
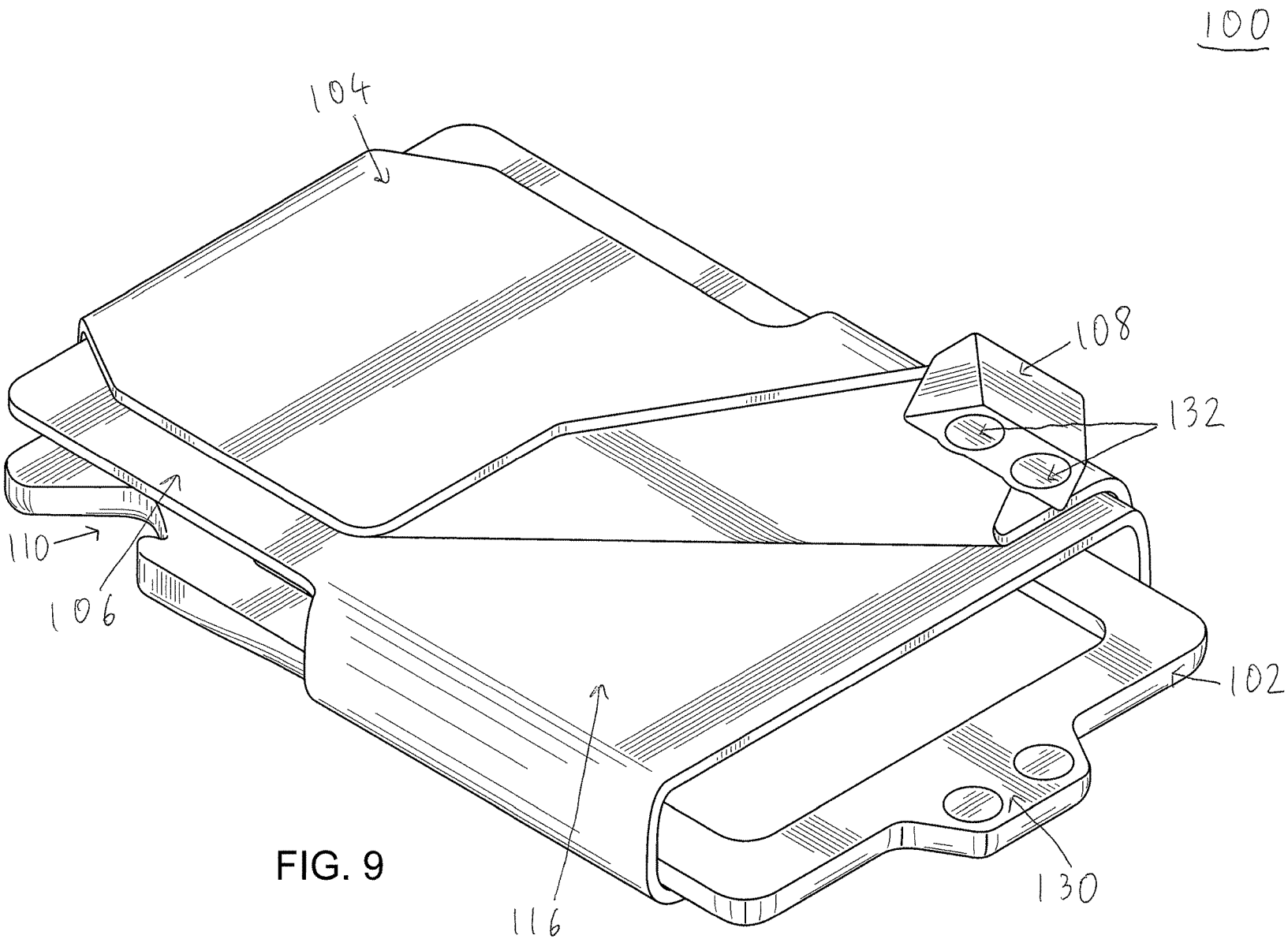
FIG. 9 shows a second perspective bottom view demonstrating a securement mechanism in an open position.

The protruding portion 114 is configured to house a magnetic material 130 (as shown in FIG. 9) in order to secure the internal compartments of the wallet 100. An example of the magnetic material may include a steel strip embedded into the frame 102. As shown in FIG. 9 the securement mechanism 108 further contains one or more magnets 132. The securement mechanism 108 is configured to be magnetically coupled with the protruding portion of the frame 102. This allows items to be selectively stored/removed from the wallet 100 as the user desires. Furthermore, the securement mechanism 108 may be manually released. The security mechanism 108 may be manually released with an application of an upward force to slide stored items (such as credit card(s) or similar items).

In another embodiment, the securement mechanism 108 includes the magnets 132 that magnetically attach to the magnetic material embedded into the frame 102. In an example scenario, a surface of the magnets 132 is exposed. The frame 102 and/or the embedded magnetic material 130 may have indentations which may correspond to shape(s) of the magnets 130 and aid in attachment of the magnets 132 to the magnetic material 130 (as shows in FIG. 9). In a preferred embodiment, there are two magnets 132 in the securement mechanism 108. However, in alternative embodiments, there may be more or less than two magnets present in the securement mechanism 108. In yet other embodiments, different numbers of magnets may reside within the securement mechanism 108. Alternatively, magnet(s) may be embedded into the frame 102 (in a location associated with the magnetic material 130) and the magnetic material may be embedded into the securement mechanism 108. The magnets embedded in the frame 102 may magnetically attach to the magnetic material in the securement mechanism 108.

The magnets 132 may also be oriented in a number of fashions. The magnets 132 may be placed side by side vertically or horizontally or placed in other configuration based on the number of magnets utilized. In at least one embodiment, the magnets 132 are "stacked" in a vertical configuration with two magnets 132 positioned in the securement mechanism 108. The magnets 132 in each row of the singular column has an opposing polarity oriented toward the magnetic material 130 embedded in the frame 102. This allows for the magnets 132 to magnetically attach to the frame 102 with the securement mechanism 108. However, it further allows the securement mechanism 108 to be slid toward a terminal end of the protruding portion 114 of the frame (as when removing a credit card from interior) such that when moved forward the magnets 132 of the securement mechanism 108 encounters a magnetic material 130 of opposing polarity in the frame 102 thereby causing the securement mechanism 108 to be magnetically repelled and releasing the connection to the frame 102 and allowing for an easy removal of the desired item. Further, the frame 102 or the securement mechanism 108 magnetic interaction allows for a "haptic" type feedback or an audible "click" to verify that the frame 102 or the securement mechanism 108 are either attached or unattached.

In another example scenario, four magnets may be embedded into the securement mechanism 108 in a two by two arrangement which includes [[North, South], [South, North]] polarities. Four magnets may also be embedded into the frame 102 in another two by two arrangement which includes [[South, North], [North, South]] polarities. The magnets embedded into the frame 102 and the magnets embedded into the securement mechanism 108 may be magnetically attached to each other. Alternatively, the arrangement of the magnets embedded into the frame 102 and the securement mechanism 108 may be reversed. The magnets in the reverse arrangement may still be magnetically attached to each other.

The first band 106 is configured to couple to the frame 102 such that a first wing 122 and a second wing 124 (see FIG. 3) are removably coupled to the frame 102. Further, a tail 126 of the first band 106 may be coupled to another side of the frame 102. The first band 106 is wholly configured to be removable from the frame 102. This allows the band color, size, shape, etc. to be interchanged as needed or desired.

The first band 106 is removably held to the frame 102 by way of a clamp 105. The clamp 105 is generally a "c" shape clamp (as visible in FIG. 7) which provides a secure connection to the frame 102. To remove the first band 106 one would simply rotate the portion of the band about the frame 102 such that the clamp 105 would release the frame 102 and allow the band to thereby be removed. In one embodiment, it is preferable that the first band is formed at least partially from an animal product such as leather. In other embodiments, it is desirable that the first band is formed from an elastic material thereby allowing objects of a variety of shapes and sizes to be conveniently stored therein.

The second band 104 may also comprise a wing 128, wing 120, and a tail 118. The second band 104 may be formed from the same or a different material as the first band 106. The second band 104 may be similar in appearance as the first band 106 while having a reduced profile or dimensions as compared to the first band 106. In at least one embodiment, the wing 120 is attached to a side of the frame 102 and the other wing 128 is attached to a separate side of the frame 102. The tail 118 of the second band 104 has the securement mechanism 108 coupled thereto. The second band 104 may be removably coupled to the frame 102 or the first band 106 using the clamps as described above. Further, in some embodiments, the second band 104 may be mechanically adhered (e.g. stitching, adhesive, etc.) to a portion of the first band 106.

The first band 106 and the second band 104 are sized and shaped such that a storage area or compartment 116 (see FIG. 1) is formed between the two bands. Further, the materials comprising the bands may include but are not limited to woven or unwoven fabric, cloth, terrycloth, woven or woven fibers of wool, flax, cotton, and/or yarn, mineral textiles, denim, elastomeric fibers/fabrics, and synthetic textiles including but not limited to nylon, polyester, and/or acrylic, or any combinations thereof. In some embodiments, the bands are made of the same or a different material. In some embodiments, each band is made up of more than one material. For example, the outer surface of the first band and the inner surface of the second band may be made of the same material which is configured to not scratch or otherwise abrade material stored in the compartment formed between the two bands.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A wallet comprising:

a frame, wherein a magnetic material is embedded into the frame;

a first band coupled to the frame, wherein the first band has a first end and a second end, the first end of the first band being coupled to a first side of the frame and the second end of the first band being coupled to a second side of the frame, and wherein the first band comprises a first wing on the first end, a second wing on the second end, and a tail;

a second band coupled to the frame, wherein the second band has a first end and a second end, the first end of the second band being coupled to a third side of the frame, and wherein the second band comprises a first wing on the first end and a tail; and a securement mechanism coupled to the second band, wherein the securement mechanism includes an embedded magnet.

2. The wallet of claim 1, wherein the magnetic material includes a steel strip.

3. The wallet of claim 1, wherein the frame has a central opening.

4. The wallet of claim 1, wherein the first band and the frame are configured to form a first compartment.

5. The wallet of claim 4, wherein the first compartment is selectively opened or closed via the securement mechanism.

6. The wallet of claim 1, wherein the first band is positioned between the frame and the second band.

7. The wallet of claim 1, wherein the embedded magnet is configured to magnetically couple to the magnetic material.

8. A wallet comprising:

a frame having a first side, a second side, and a third side, wherein a steel strip is embedded in the frame;

a first band having a first end and a second end, the first end of the first band being coupled to the first side and the second end of the first band being coupled to the second side, wherein the first band comprises a first wing on the first end, a second wing on the second end, and a tail; and a second band having a first end and a second end, the first end of the second band being coupled to the third side and the second end having a securement device disposed, wherein the securement device includes an embedded magnet, wherein the second band comprises a first wing on a first end and a tail, and wherein the first band is positioned between the frame and the second band.

9. The wallet of claim 8, wherein the embedded magnet is configured to magnetically couple to the steel strip.

10. The wallet of claim 8, wherein a second compartment is formed between the first band and the second band.

11. The wallet of claim 8, further comprising a clamp coupled to the first band, wherein the clamp is configured to removably couple the first band to the frame.

12. The wallet of claim 8, wherein the steel strip protrudes outwardly from the frame.

13. A wallet comprising:

a frame having an open portion, a first side, a second side, and a third side, wherein the frame includes an embedded magnet;

a first band having a first end and a second end, the first end of the first band being coupled to the first side and the second end of the first band being coupled to the second side, wherein the first band is coupled to the frame with a first removable clamp, and wherein the first band comprises a first wing on the first end, a second wing on the second end, and a tail;

a second band having a first end and a second end, the first end of the second band being coupled to the third side and the second end with a securement device, wherein the securement device includes an embedded magnetic material, wherein the second band is coupled to the frame with a second removable clamp, wherein the second band comprises a first wing on the first end and a tail, wherein the first band is positioned between the frame and the second band, and wherein the embedded magnet is configured to magnetically couple to the embedded magnetic material.

14. The wallet of claim 13, wherein the second band has reduced dimensions as compared to the first band.

* * * * *